US009033437B2

(12) United States Patent
Klitzing et al.

(10) Patent No.: US 9,033,437 B2
(45) Date of Patent: May 19, 2015

(54) SLIDE ASSEMBLY FOR REFRIGERATOR STORAGE DRAWER

(71) Applicant: Whirlpool Corporation, Benton Harbor, MI (US)

(72) Inventors: Frank W. Klitzing, Evansville, IN (US); Kyle E. Laine, Newburgh, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/832,845

(22) Filed: Mar. 15, 2013

(65) Prior Publication Data

US 2014/0265801 A1 Sep. 18, 2014

(51) Int. Cl.
*A47B 88/04* (2006.01)
*F25D 25/02* (2006.01)

(52) U.S. Cl.
CPC ..... *F25D 25/025* (2013.01); *A47B 88/0466* (2013.01)

(58) Field of Classification Search
USPC ..... 312/401, 404, 402, 330.1, 334.1, 312/334.27, 334.32, 334.36, 334.39, 312/334.41; 384/19, 20, 58; 62/382
See application file for complete search history.

(56) References Cited

U.S. PATENT DOCUMENTS

| | | | | | |
|---|---|---|---|---|---|
| 608,130 | A | * | 7/1898 | Kandle | 312/334.27 |
| 2,255,290 | A | * | 9/1941 | Kennedy | 312/334.39 |
| 2,889,907 | A | * | 6/1959 | Sullivan | 193/35 R |
| 3,301,610 | A | | 1/1967 | Packett | |
| 4,095,853 | A | * | 6/1978 | MacDonald | 384/19 |
| 4,317,607 | A | * | 3/1982 | Gomolka | 312/236 |
| 4,834,557 | A | | 5/1989 | Dreinhoff | |
| 4,979,262 | A | | 12/1990 | Lautenschlager | |
| 5,090,820 | A | | 2/1992 | Lautenschlager | |
| 5,882,100 | A | * | 3/1999 | Rock | 312/334.34 |
| 5,918,959 | A | * | 7/1999 | Lee | 312/404 |
| 2005/0156494 | A1 | * | 7/2005 | Bergmann et al. | 312/404 |
| 2011/0241515 | A1 | * | 10/2011 | Park et al. | 312/408 |

FOREIGN PATENT DOCUMENTS

| | | | |
|---|---|---|---|
| CN | 2881472 | | 3/2007 |
| JP | 3419988 | | 4/2003 |
| JP | 2008121976 | | 5/2008 |
| KR | 2003021799 | A | 3/2003 |
| KR | 2003023801 | A | 3/2003 |
| KR | 2003-0039024 | | 5/2003 |
| KR | 1020040064564 | | 7/2004 |
| KR | 2009106233 | A | 10/2009 |
| KR | 2010018234 | A | 2/2010 |
| KR | 1020100023474 | | 3/2010 |
| KR | 101028583 | B1 | 9/2010 |
| KR | 100998369 | | 11/2010 |
| KR | 101013683 | | 1/2011 |

* cited by examiner

*Primary Examiner* — James O Hansen

(57) ABSTRACT

A slide assembly for a drawer inside a refrigerator employs both side and central rollers which control both horizontal and vertical movement of the drawer through a first set of rollers employed at front and rear portions at each side of the drawer to control vertical movement within side tracks while the drawer is moved between an extended position and a retracted position. A second set of rollers is mounted along axes which are arranged 90 degrees relative to the first set of rollers and underneath the drawer. This second set of rollers control side-by-side movement of the drawer as it is opened and closed. In one embodiment, the second set of rollers is mounted in a refrigerated compartment and travel within a track or guideway mounted on the bottom of the drawer.

19 Claims, 4 Drawing Sheets

SLIDE ASSEMBLY FOR REFRIGERATOR STORAGE DRAWER

BACKGROUND OF THE INVENTION

1. Field of the Invention

The present invention pertains to the art of refrigerators and, more particularly, to an enhanced roller system for supporting a food storage drawer, such as a crisper bin, for sliding movement within a refrigerator compartment.

2. Description of the Related Art

In the art of refrigerators, particularly household refrigerators, it is often desirable to create varying humidity and/or temperature storage zones to enhance the preservation of different food items. For instance, it is common to accommodate the storage requirements for certain food items, such as dairy products, meats, fruits and vegetables, by forming separately enclosed storage areas within a fresh food compartment. In most instances, these storage areas are designed to be maintained at temperatures which are different from the temperature of the remainder of the fresh food compartment.

In at least the case of fruits and vegetables, it is typically desirable to isolate these food items from direct contact with a flow of cooling air, especially any cold air flowing into the fresh food compartment from a freezer compartment of the refrigerator, mainly because this cold air can be fairly dry. Therefore, in order to isolate the fruits and vegetables from the desiccating effects of the cold air so as to maintain the moisture content of the fruits and vegetables, it has heretofore been proposed to provide a specialized storage receptacle, such as a crisper, within a refrigerator fresh food compartment. A crisper generally takes the form of a slidable bin which is sealed to maintain a relatively high humidity level, while the walls of the bin are chilled to establish a desirable temperature within the bin.

Many different designs have been proposed in the art to support such storage receptacles for sliding movement. Basically, there are three main designs: one providing for side flanges on the receptacle to be directly, slidably supported on guide tracks; another employing a roller system wherein each side of the receptacle is mounted through front and rear rollers for movement between extended and retracted positions; and the last design employing ball bearing glides. In general, the direct sliding supports are functional but permit multidirectional movement of the drawer, resulting in a noisy and somewhat cumbersome arrangement. Even the best known roller systems still exhibit hard surface contact along sides of the drawer which cause friction and noise. Although bearing glides exhibit a large improvement in strength and quality perception, they are expensive and can have lubrication and other issues in the cold environment of refrigerators. With the above in mind, there still exists a need for an enhanced roller system for supporting a food storage bin, such as a crisper drawer, for movement within a refrigerator compartment.

SUMMARY OF THE INVENTION

The present invention is directed to a slide assembly for a drawer, such as a crisper drawer, inside a refrigerator. The drawer slide assembly employs both side and central rollers which control both horizontal and vertical movement of the drawer. In a preferred embodiment of the invention, six lubricated rollers are employed in preventing any hard surfaces from rubbing together, with four of the rollers constituting a first set which are employed at front and rear portions at each side of the drawer to control vertical movement within a side track while the drawer is moved between an extended or open position and a retracted or closed position. The additional or second set of rollers is mounted along axes which are arranged 90 degrees relative to the first set of rollers and underneath the drawer. This second set of rollers control side-by-side movement of the drawer as it is opened and closed. In one embodiment, the second set of rollers is mounted in a refrigerated compartment and travel within a central guide provided on the bottom of the drawer.

The various rollers are lubricated to dampen noise and movement such that the slide assembly provides for a very smooth, quiet and robust-feeling drawer operation. Additional objects, features and advantages of the invention will become readily apparent from the following detailed description of a preferred embodiment of the invention when taken in conjunction with the drawings wherein like reference numerals refer to corresponding parts in the several views.

DETAILED DESCRIPTION OF PREFERRED EMBODIMENTS

Figure 1:
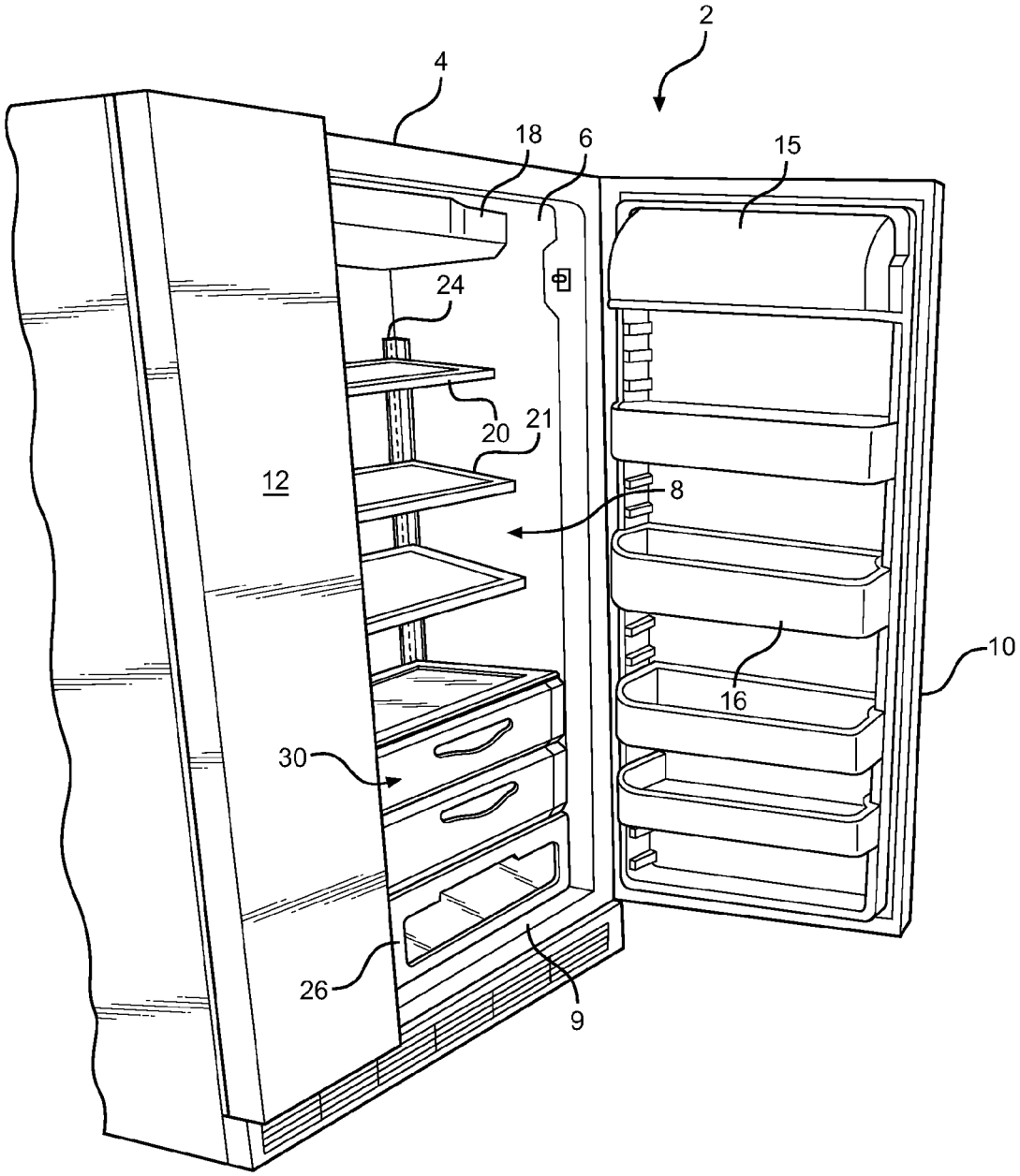
FIG. 1 is a partial, front perspective view of a side-by-side refrigerator incorporating the drawer slide assembly of the present invention in the fresh food compartment thereof.

With initial reference to FIG. 1, a refrigerator cabinet 2 includes a shell 4 within which is positioned a liner 6 that defines a fresh food compartment 8 having a base 9. In a manner known in the art, fresh food compartment 8 can be accessed by the selective opening of a fresh food door 10. In a similar manner, a freezer door 12 can be opened to access a liner defined freezer compartment (not shown). For the sake of completeness, refrigerator cabinet 2 is shown to include, on door 10, a dairy compartment 15 and various vertically adjustable shelving units, one of which is indicated at 16. Mounted in an upper area of fresh food compartment 8 is a temperature control housing 18 which, in a manner known in the art, can be used to regulate the temperature in both fresh food compartment 8 and the freezer compartment. Further illustrated, for exemplary purposes, is a plurality of shelves 20-22 which are cantilevered from spaced rails, one of which is indicated at 24. At a lowermost portion of fresh food compartment 8 is illustrated a slidable drawer 26, such as a crisper bin or other food receptacle, which, as will be detailed fully below, has associated therewith the drawer slide assembly of the invention. For the sake of completeness, FIG. 1 also illustrates two temperature controlled compartment systems, one of which is indicated at 30, mounted above drawer 26.

Figure 2:
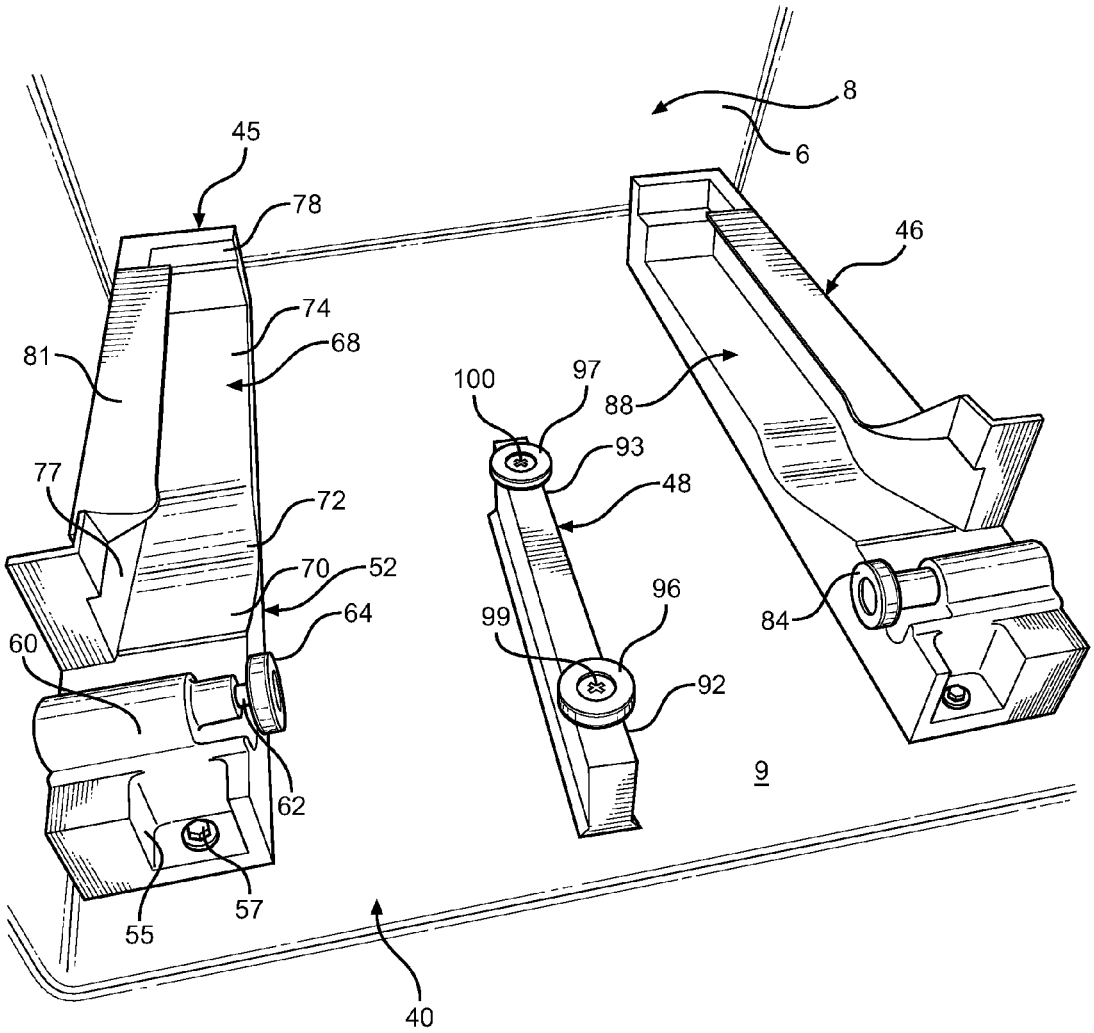
FIG. 2 is an enlarged, partial perspective view of a lower or compartment mount system employed in the drawer slide assembly of FIG. 1.

Reference will now be made to FIG. 2 in describing in detail portions of a slide assembly 40 employed with drawer 26 in accordance with an exemplary embodiment of the invention. As shown, slide assembly 40 includes first and second spaced side roller tracks 45 and 46, as well as an upstanding central roller support 48, mounted to base 9 of liner 6 within fresh food compartment 8. As side roller tracks 45 and 46 are identically constructed, although mirror images of each other, particular attention will be given to detailing the construction of side roller track 45 and it is to be understood that side roller track 46 has corresponding structure.

As clearly shown in this figure, side roller track 45 includes a main body 52 provided with a frontal recess 55 in which is located a mechanical fastener 57 used, preferably in combination with rear mounting structure (not shown), in fixedly securing side roller track 45 to base 9. Located rearward of frontal recess 55 is a shaft support housing portion 60 from which laterally or horizontally projects a stub shaft 62 that rotatably supports a roller 64. Behind shaft support housing portion 60 is a roller surface 68, successively including a downward and rearward sloping portion 70, a trough portion 72 and a substantially flat or level portion 74. Side roller track 45 is also shown to include an upstanding side wall 77, a terminal end wall 78 and a cantilevered overhang portion 81. Again, side roller track 46 is correspondingly constructed, thereby including an analogous roller 84 and roller surface 88. At this point, it should be noted that rollers 64 and 84 form part of a first set of rollers employed in slide assembly 40.

Central roller support 48 includes a frontal portion 92 and a rear portion 93. Mounted atop central roller support 48 at frontal portion 92 is a roller 96. Similarly, a roller 97 is also mounted upon rear portion 93. At this point, a few configuration aspects should be noted. First of all, it should be apparent that central roller support 48 is only shown to extend in a front portion of base 9, wherein side roller tracks 45 and 46 extend almost the entire depth of base 9. Actually, in the embodiment shown, central roller support 48 basically extends up to flat portion 74 of roller surfaces 68 and 88. In addition, where rollers 64 and 84 rotate about substantially horizontal axes, rollers 96 and 97, which form a second set of rollers in accordance with the invention, rotate about substantially vertical axes as established by axle defining fasteners 99 and 100.

Figure 3:
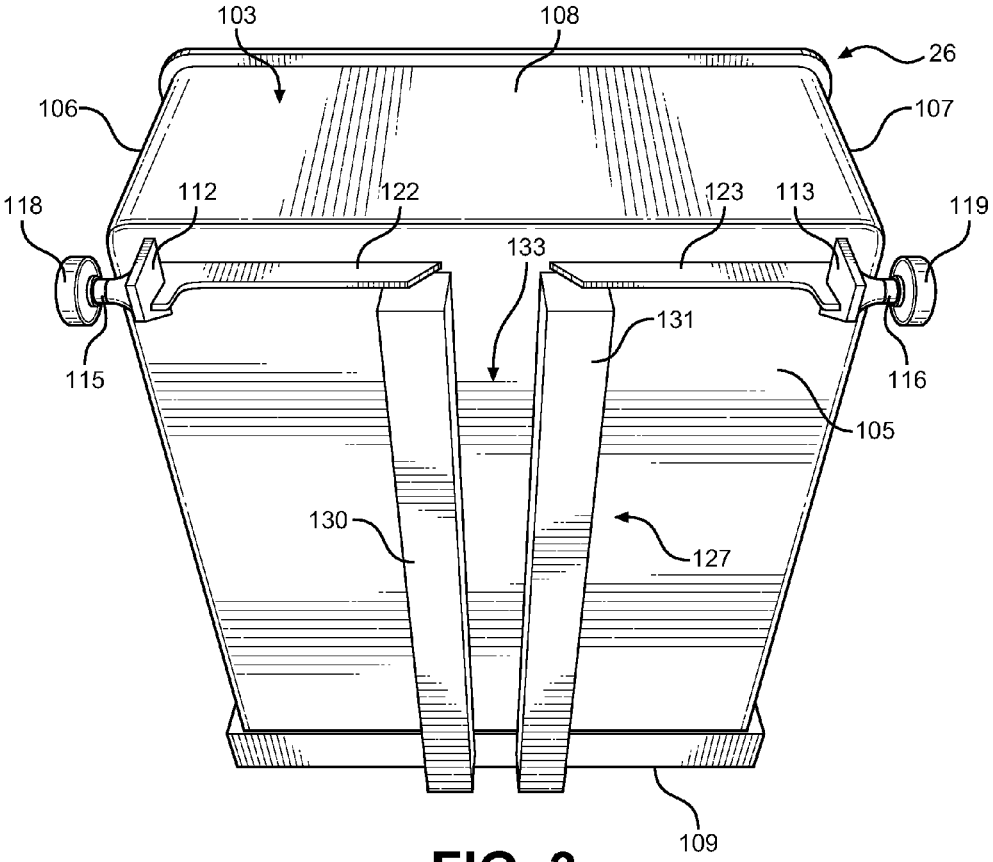
FIG. 3 is a lower perspective view of a bottom of the drawer shown in FIG. 1.

FIG. 3 will now be referenced in describing a preferred form for drawer 26, as well as additional structure associated with slide assembly 40 for the mounting of drawer 26. Basically, drawer 26 includes a storage body 103 established by a bottom wall 105, side walls 106 and 107, a rear wall 108 and a front wall 109. Bottom wall 105 is provided with a pair of spaced, rear support plates 112 and 113 from which project stub axles 115 and 116 for rollers 118 and 119. Rollers 118 and 119 are positioned laterally outwardly of side walls 106 and 107, while combining with rollers 64 and 84 to define the first set of rollers of slide assembly 40. Drawer 26 can be molded, such as from plastic, so as to define a unitary structure or can be formed from multiple interconnected pieces in a manner known in the art. In the embodiment shown, drawer 26 is molded to establish at least bottom wall 105, side walls 106 and 107, rear wall 108, support plates 112 and 113, and a pair of reinforcing ribs 122 and 123.

Figure 4:
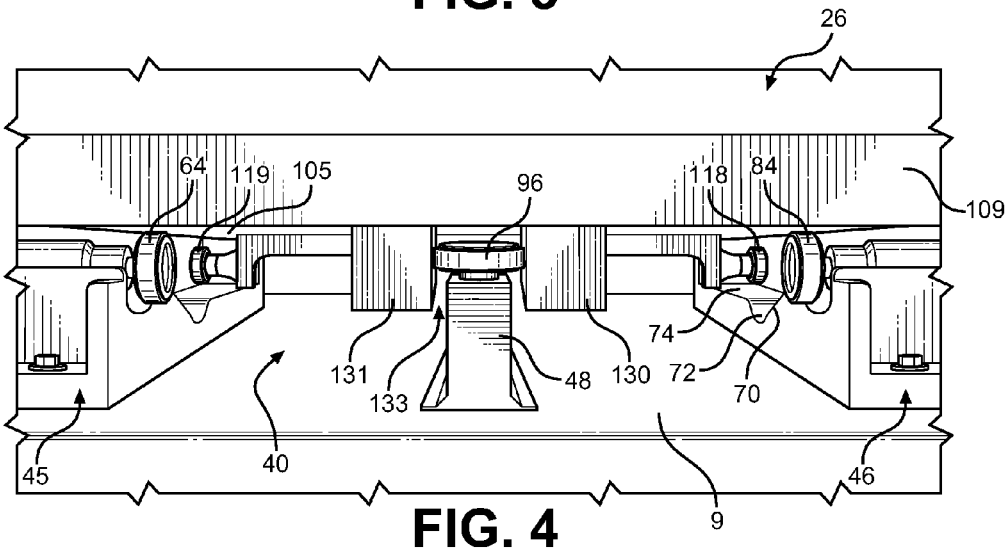
FIG. 4 is a lower front of the drawer slide assembly of the invention.

Also provided on bottom wall 105 is a guide which is generally indicated at 127. Basically, guide 127 is established by a pair of laterally spaced, fore-to-aft extending blocks 130 and 131 between which is defined a guideway 133. As best shown in FIG. 4, guideway 133 is sized to receive roller 96, as well as roller 97 of the second set of rollers, when drawer 26 is mounted through slide assembly 40 for movement between extended and retracted positions within fresh food compartment 8. At the same time, rollers 118 and 119 carried by drawer 26 are supported upon roller surfaces 88 and 68 respectively. In addition, bottom wall 105 rests upon rollers 64 and 84. In this fashion, slide assembly 40 supports drawer 26 for sliding movement between extended and retracted positions with the first set of rollers 64, 84, 118 and 119 controlling vertical movement of drawer 26 (specifically note that rollers 118 and 119 are captured between respective roller surfaces 68, 88 and overhang portions 81) and the second set of rollers 96 and 97 controlling side-by-side movement of drawer 26. These functions are performed as the second set of rollers 96, 97 is mounted along axes which are arranged 90 degrees relative to the first set of rollers 64, 84, 118 and 119. Overall, this configuration has been found to provide an extremely smooth, quiet and robust-feeling drawer operation which is preferred, particularly in higher end appliance models.

Figure 5:
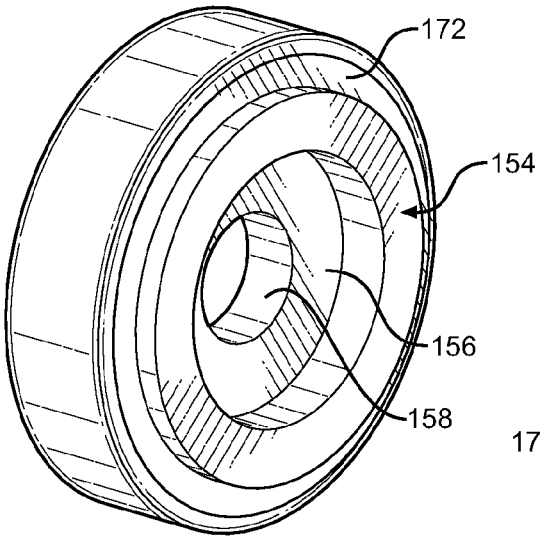
FIG. 5 is a perspective view of a roller, which is part of a roller unit employed in the drawer slide assembly of the invention.
Figure 6:
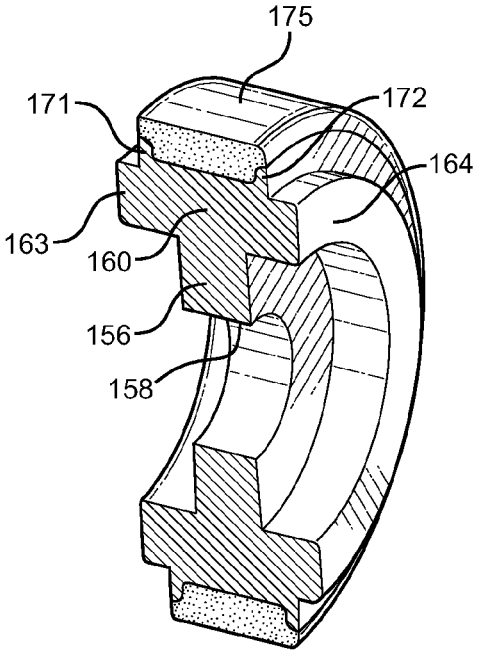
FIG. 6 is a partial cross-sectional view of the roller of FIG. 5.
Figure 7:
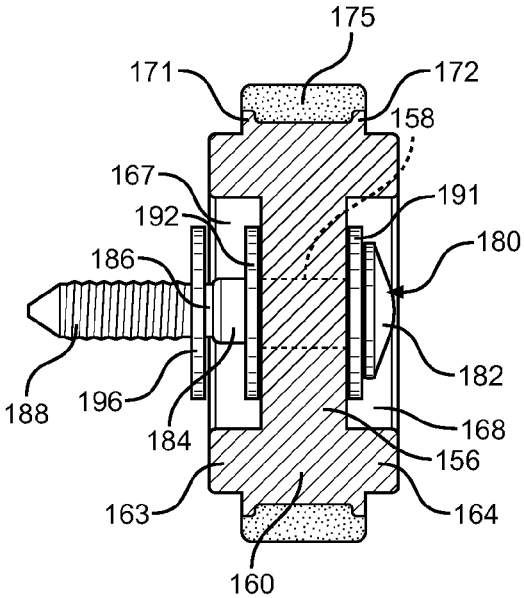
FIG. 7 is a cross-sectional view of an overall roller unit including the roller of FIG. 5.

In connection with providing the desired smooth and quiet operation, the most preferred form of the invention employs lubricated rollers for each of rollers 64, 84, 96, 97, 118 and 119. Keeping in mind that each of these rollers is shown to be identically constructed, reference will now be made to FIGS. 5-7 in describing a preferred form of these rollers, each of which includes a roller body 154 having an inner radial portion 156, provided with a central through hole 158, and an outer radial portion 160. As shown, outer radial portion 160 has an increased axial dimension relative to inner radial portion 156, with this increased dimension being established by inner and outer axial extensions 163 and 164. Based on this construction, inner and outer axial recesses 167 and 168 are formed within the confines of inner and outer axial extensions 163 and 164 respectively. Also, projecting radially from outer radial portion 160 are upstanding circumferential lip members 171 and 172. Finally, roller body 154 is provided with an outer, elastomeric tread 175.

Although each roller 64, 84, 96, 97, 118 and 119 could be made from various materials, a preferred embodiment employs acetal for roller body 154 and neoprene rubber for tread 175. Also provided for rotatably supporting and mounting each roller 64, 84, 96, 97, 118, 119 is a screw 180 which defines a respective axle and rotational axis. More specifically, each screw 180 includes a head 182, a shaft 184, a transition region 186 and a threaded region 188. Interposed between head 182 and inner radial portion 156, within outer axial recess 168, is a first washer 191, preferably made of TEFLON. In a similar manner, a second TEFLON washer 192 is provided about shaft 184 within inner axial recess 167. Importantly, lubricant (not shown) is provided in through hole 158 about shaft 184 and washers 191 and 192 effectively hold in this lubricant. In addition, an inner axial washer 196 is preferably press-fit onto transition region 186 to finish each roller so as to minimize slop and hold the parts together prior to mounting. Once mounted, this construction will assure that head 182 stays within the confines of outer axial extension 164, while washer 196 will be substantially flush with inner axial extension 163.

Based on the above, it should be readily apparent that the slide assembly of the invention controls both the permissible vertical and horizontal, i.e., lateral, movement of the drawer within the compartment, while also establishing a high quality and functioning glide system. It has been found that the forward mounting of the central roller arrangement actually simplifies the overall insertion of the drawer into the food compartment after removal for cleaning or the like. Although described with respect to preferred embodiments of the invention, it should be readily apparent that various changes and/or modifications can be made to the invention without departing from the spirit thereof. For instance, the invention has been disclosed for use with the lowermost crisper drawer in the refrigerator, thereby enabling the use of the compartment base for mounting purposes. However, the invention could also be applied to drawers which are arranged vertically above the compartment base by establishing a base or platform directly below the drawer. In addition, it should be recognized that the central roller and guideway configuration could be reversed such that the guideway is established on the base and the central rollers are carried by the drawer. In any event, the invention is only intended to be limited by the scope of the following claims.

We claim:

1. A refrigerator comprising:

a cabinet having defined therein a refrigerator storage compartment; and a drawer assembly including:

a drawer including a storage body, wherein the storage body includes a bottom wall, side walls, a rear wall and a front wall; and a slide assembly for supporting the drawer for sliding movement between extended and retracted positions, said slide assembly including a first set of rollers controlling vertical movement of the drawer and a second set of rollers controlling side-by-side movement of the drawer, said slide assembly further including first and second spaced tracks mounted in the refrigerator storage compartment, said first set of rollers including first and second pairs of rollers, with the first pair of rollers being mounted to the storage body of the drawer adjacent the rear wall and seated in the first and second spaced tracks and the second pair of rollers being mounted to the first and second spaced tracks, wherein the second pair of rollers remains engaged with the bottom wall of the storage body as the drawer is shifted between the extended and retracted positions.

2. The refrigerator according to claim 1, wherein the second set of rollers is mounted along axes which are arranged 90 degrees relative to the first set of rollers.

3. The refrigerator according to claim 2, wherein the second set of rollers is mounted beneath the drawer.

4. The refrigerator according to claim 1, wherein the slide assembly further includes a central guide extending fore-to-aft along the storage body, with the second set of rollers engaging the central guide.

5. The refrigerator according to claim 1, wherein the first set of rollers constitutes at least four rollers and the second set of rollers includes two additional rollers.

6. The refrigerator according to claim 1, wherein each roller of the first and second sets of rollers includes a roller body having inner and outer radial portions, a through hole in the inner radial portion, an outer tread portion about the outer radial portion, an axle defining shaft extending through the through hole and at least one washer retaining the roller body and shaft assembled.

7. The refrigerator according to claim 6, further comprising: inner and outer axial washers provided on either side of the through hole for retaining lubricant between the roller body and the shaft.

8. A refrigerator comprising:

a cabinet having defined therein a refrigerator storage compartment, wherein the refrigerator storage compartment is defined by a liner; and a drawer assembly including:

a drawer including a storage body; and a slide assembly for supporting the drawer for sliding movement between extended and retracted positions, said slide assembly including a first set of rollers controlling vertical movement of the drawer, a second set of rollers controlling side-by-side movement of the drawer and a central guide extending fore-to-aft along the storage body for movement with the drawer, wherein the second set of rollers is mounted to the liner beneath the drawer such that the drawer is shiftable between the extended and retracted position relative to the second set of rollers, with the second set of rollers being mounted along axes which are arranged 90 degrees relative to the first set of rollers and engaged with the central guide.

9. The refrigerator according to claim 8, wherein the slide assembly further includes first and second spaced tracks mounted in the refrigerator storage compartment, said first set of rollers includes a first pair of rollers mounted to the storage body and a second pair of rollers mounted to the first and second spaced tracks.

10. The refrigerator according to claim 9, wherein the storage body includes a bottom wall, side walls, a rear wall and a front wall, said first pair of rollers being mounted to the drawer adjacent the rear wall and being seated in the first and second spaced tracks.

11. The refrigerator according to claim 10, wherein the first pair of rollers is rotatably mounted on stub axles extending from beneath the bottom wall laterally outward of the side walls.

12. The refrigerator according to claim 10, wherein the second pair of rollers remains engaged with the bottom wall of the storage body as the drawer is shifted between the extended and retracted positions.

13. A refrigerator comprising:

a cabinet having defined therein a refrigerator storage compartment; and a drawer assembly including:

a drawer including a storage body including a bottom wall, side walls, a rear wall and a front wall; and a slide assembly for supporting the drawer for sliding movement between extended and retracted positions, said slide assembly including first and second spaced tracks mounted in the refrigerator storage compartment, a first set of rollers controlling vertical movement of the drawer, and a second set of rollers controlling side-by-side movement of the drawer, said first set of rollers including first and second pairs of rollers, with the first pair of rollers being mounted to the storage body of the drawer adjacent the rear wall, seated in the first and second spaced tracks and rotatably mounted on stub axles extending from beneath the bottom wall laterally outward of the side walls, and with the second pair of rollers being mounted to the first and second spaced tracks.

14. The refrigerator according to claim 13, wherein the second set of rollers is mounted along axes which are arranged 90 degrees relative to the first set of rollers.

15. The refrigerator according to claim 13, wherein the second set of rollers is mounted beneath the drawer.

16. The refrigerator according to claim 13, wherein the refrigerator storage compartment is defined by a liner and the second set of rollers is mounted to the liner such that the drawer is shiftable between the extended and retracted position relative to the second set of rollers.

17. The refrigerator according to claim 13, wherein the second pair of rollers is mounted to the first and second spaced tracks and remains engaged with the bottom wall of the storage body as the drawer is shifted between the extended and retracted positions.

18. The refrigerator according to claim 13, wherein first set of rollers constitutes at least four rollers and the second set of rollers includes two additional rollers.

19. The refrigerator according to claim 13, wherein each roller of the first and second sets of rollers includes a roller body having inner and outer radial portions, a through hole in the inner radial portion, an outer tread portion about the outer radial portion, an axle defining shaft extending through the through hole and at least one washer retaining the roller body and shaft assembled.

* * * * *